US005555903A

United States Patent [19]

Rizzotti

[11] Patent Number: 5,555,903

[45] Date of Patent: Sep. 17, 1996

[54] AERODYNAMIC UMBRELLA

[76] Inventor: Salvatore A. Rizzotti, 2 Elizabeth La., West Yarmouth, Mass. 02673

[21] Appl. No.: 383,796

[22] Filed: Feb. 6, 1995

[51] Int. Cl.[6] ..... A45B 3/00

[52] U.S. Cl. ..... 135/16; 135/20.1; 135/33.2

[58] Field of Search ..... 135/16, 19, 20.1, 135/15.1, 31, 33.2

[56] References Cited

U.S. PATENT DOCUMENTS

| | | | |
|---|---|---|---|
| 2,756,760 | 7/1956 | Grotteria | 135/16 X |
| 2,871,868 | 2/1959 | Faasse et al. | 135/20.1 X |
| 3,765,434 | 10/1973 | Riggs | 135/16 X |
| 4,132,236 | 1/1979 | Petersen et al. | 135/16 |
| 4,347,862 | 9/1982 | Secon | 135/20.1 |
| 4,505,285 | 3/1985 | French | 135/16 X |

*Primary Examiner*—Lanna Mai

[57] ABSTRACT

An aerodynamic umbrella having a curved canopy mounted on a horizontally disposed extension shaft which is rotatably mounted on a vertical mast, such canopy having a stabilizer member on the top thereof and being able to rotate the umbrella into the wind.

8 Claims, 1 Drawing Sheet

AERODYNAMIC UMBRELLA

BACKGROUND OF THE INVENTION

1. Field of the Invention

The structure of this invention resides in the area of outdoor umbrellas and more particularly relates to a patio-type umbrella which has wind-resistant, aerodynamic features.

2. Description of the Prior Art

Patio umbrellas are usually concave, inverted, fabric-covered structures supported by a plurality of struts and ribs mounted on a central mast. Such umbrellas are often adversely affected by strong wind which can blow them over, and many inventions have been directed to improving such patio umbrellas to better withstand strong winds such as by providing vents in their fabric covering and by providing mast structures which can allow wind to pass therethrough in various ways. Some patio umbrellas are spring-loaded, that is, their concave structure is movable when sufficient wind force is exerted thereon. One patio umbrella of the prior art spins on its central shaft when strong wind blows against it in order to dissipate the force of the wind.

Despite the incorporation of such wind-resistant features, prior art canopy umbrellas are still adversely affected by strong wind forces which can turn their canopies inside-out, uproot their masts and/or tip them over. Another negative of prior art structures is that their construction is labor-intensive because of their complicated construction and their many parts. Many times it is completely impractical to repair them because of the high cost of repairing their thin metal struts which can be bent from high winds. Thus, if damaged, such prior art umbrellas must often be thrown away.

Further, the designs of typical prior art umbrellas have been primarily limited to rounded, curved canopies so that they can open symmetrically.

SUMMARY OF THE INVENTION

It is an object of this invention to provide an aerodynamic patio umbrella which can withstand the force of strong winds against it by pivoting into the direction of the wind and allowing the wind to flow over and under its canopy.

It is a further object of this invention to provide a patio umbrella of simple construction, the parts of which can be easily assembled, repaired and/or replaced.

By the use of aerodynamic principles the canopy of this umbrella is much more stable than the typical rounded structures of the prior art and is of a much simpler construction, resulting in its being easier to set up because it has fewer parts. The canopy is also cheaper to build because of its simple structure and has many significant advantages as an outdoor beach or patio-type umbrella or for use in combination with outdoor furniture.

The key features of the umbrella of this invention are its keystone-shaped canopy and its unique supporting structure. The mast, having a right angle displacement in it, is comprised of a horizontal extension shaft which extends perpendicular to the lower vertical portion of the mast. The front end of the horizontal extension shaft is attached to the canopy supporting structure. The right angle displacement can be an elbow bend in the horizontal extension shaft which is pivotally connected to the mast which allows such horizontal extension shaft to freely rotate on the mast. The structure supporting the canopy consists of four members: a central support member which is disposed centrally along the top edge of a stabilizer member and three rib member disposed generally parallel thereto. At the front of the canopy are first and second support members meeting at and joining with the front end of the central support member to form the nose of the umbrella structure. The canopy is attached to its supporting structure along the first and second support members by means of sleeve members formed by portions of the canopy disposed around such first and second support members, and the central support member is inserted into a channel formed along the top edge of the stabilizer member. The three, generally flat rib members are attached to the canopy by placement within their respective, spaced-apart channels formed along the length of the canopy. The three rib members are fixed in position in their respective channels by their channel closures which can be tightenable buckles located, respectively, at each rear corner and center of the rear portion of the canopy at the top of the stabilizer member. The central support member is pre-bent into a curve and the rib members are also slightly curved near their front portions through tensioning by pressure from the channel closure members against each rib's end. The stabilizer member extends vertically downward from its attachment to the central support member to its junction with the top of the canopy. The first and second support members are disposed at an obtuse angle to one another and are swept back at a slight angle from the front toward the rear. The lateral sides of the canopy are tapered rearward along their edges with the tension-curved ribs and pre-bent, curved-central support member disposed within their respective channels formed within the canopy fabric, producing a slight curvature at the front of the canopy. As the wind blows thereover, such curvature acts as an aerodynamic foil and causes a slight lifting effect on the front of the canopy yet keeps the canopy stable as the structure is directed to aim into the wind by the action of the wind on the stabilizer member. The shape of the canopy structure is such that the stabilizer member on the top center length of the canopy aids in moving the umbrella and directing the front of the canopy to face into the wind. As the wind blows against the umbrella, the front of the canopy structure rotates, causing the horizontal extension shaft to rotate at its pivot point on the mast and pivot into the direction of the wind. This pivoting feature is automatic.

DESCRIPTION OF THE PREFERRED EMBODIMENT(S)

Figure 1:
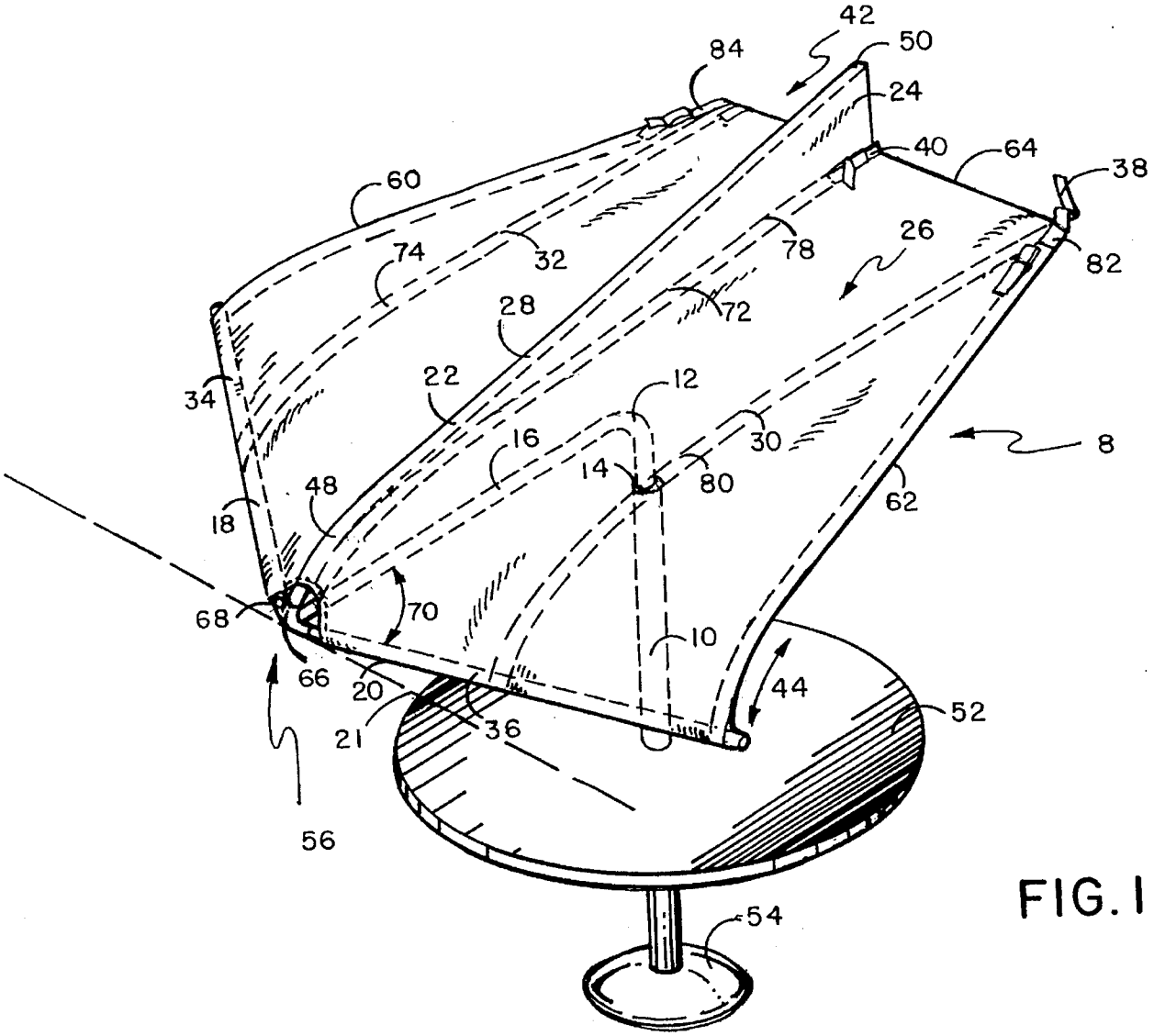
FIG. 1 illustrates a perspective view of the aerodynamic umbrella of this invention mounted on a mast above a patio table.

FIG. 1 illustrates a perspective view of canopy 8 of this invention mounted on mast 10 which extends vertically from a patio table 52 which rests on a base 54 on the ground. Extending from the top of mast 10 is elbow 12 which is rotatably attached to pivot 14 such that horizontal extension shaft 16 which extends perpendicularly to mast 10 can be freely spun in horizontal orientation to any position parallel to table 52 and to the ground. At the front of the canopy horizontal extension shaft 16 is engaged into one of four interconnection members of junction 68 located at nose 56 of the canopy. First support member 18 and second support member 20 are engaged into two other interconnection members. These support members extend rearward at an acute angle 70 to a line 21 drawn perpendicular to horizontal extension shaft 16 and are in the same horizontal plane as horizontal extension shaft 16. Extending from the top of the junction 68 is central support member 22 which is engaged into the fourth interconnection member. Central support member 22 extends gradually upward within its channel 28 and is curved by pre-bending near its front end and then extends along the top edge of stabilizer member 24 to its rear end 50. Second rib 72 extends below central support member 22 along the bottom edge of stabilizer 24 within second channel 78. The front portion of the canopy is engaged to its supporting structure by having first support member 18 and second support member 20 being disposed, respectively, within first sleeve 34 and second sleeve 36 of the canopy. A small open area 66 in the canopy can be formed around junction 68. Within the body of canopy 8 is also formed first channel 32 and third channel 30 which extend rearward, respectively, from the midpoints of first sleeve 34 and second sleeve 36 to first sleeve rear corner 84 and second sleeve rear corner 82, respectively, at the rear portion of the canopy structure. Within first channel 32 and third channel 30 are positioned, respectively, first rib 74 and third rib 80 which ribs can be made of flat, flexible but stiff material such as metal, fiberglass, plastic or other equivalent material, being tension-curved at their front portions to form a canopy curvature 44. Apertures in each of the rib channels are located at their ends at the rear of the canopy. First, second, and third ribs 74, 72 and 80 are retained within their respective channels by channel closures such as first channel closure 42, second channel closure 40 and third channel closure 38 which channel closures can be catch strap buckles or equivalent means located at the rear of the canopy to cover the apertures and retain the ribs tightly under tension within their respective channels to help maintain the generally horizontally disposed, curved structure of the canopy of this invention. Third channel closure 38 is shown in an open position while the others are shown in a closed position. Channel 28 contains central support member 22. Extending below central support member 22 to the top surface of canopy 8 is stabilizer member 24 which is generally wedge-shaped, being lower in height at its front 48 and rising in height at its rear and formed above second rib 72. The stabilizer member causes the umbrella of this invention to act like a weathervane when wind blows against the structure and causing nose 56 at the front of the canopy to always face into the wind. Canopy curvature 44 causes a slight aerodynamic foil effect to occur, resulting in a slight lifting at such curvature while at the same time depressing tail end 64 of the canopy by the flow of wind. These dual effects help to retain the canopy securely in place on its mast as it rotates on pivot 14 and maintains its position facing into the wind. Stabilizer member 24 can be made of fabric 26 or equivalent planar material sewn, glued or attached by well known equivalent means. First side 60 and second side 62 of canopy 8 taper inward, respectively, from the outermost ends of first and second support members 18 and 20 at the front of the canopy to first and second rear corners 84 and 82 at the rear of the canopy. The rearwardly angled support members and the inwardly tapered sides give the canopy its distinctive keystone shape when viewed from above. The tensioned, curved ribs and pre-curved central support member help to tension the surface of the canopy into an aerodynamic shape. Because first rib 74 and third rib 80 run, respectively, from a central position along first support member 18 and second support member 20 to rear first corner 84 and rear second corner 82, the keystone shape of the canopy is maintained because of the fabric tension existing from the front outer corners to the rear corners as well as from the rear corners inward to second rib 72; and fabric tension is uniformly distributed to prevent any buckling of the canopy surface.

The poles which make up the three support members and the horizontal extension shaft can be interengaging solid or tubular poles adapted to fit into a four-way receptacle junction 68 located at the front of the canopy structure. Such four-way receptacle junction can telescopically receive the front end of horizontal extension shaft 16, the inner ends of first and second support members 18 and 20 and the front end of central support member 22. Elbow structure 12 can be comprised of a uniform bend in the pole or comprised of component parts to enable horizontal extension shaft 16 to extend at a right angle from the vertically upright mast 10 a distance sufficient to dispose the front of the canopy offset a desired distance to one side of the mast, and the rear of the canopy extends over to the opposite side at least an equivalent distance with the canopy disposed to cover the table or desired area as the horizontal extension shaft rotates on pivot 14.

The structure of this invention can be manually assembled without the use of tools and has only a few replaceable parts which replaceable parts can lengthen the useful life of the umbrella of this invention. It should be noted that the canopy of the umbrella can be constructed in a variety of different shapes while still maintaining its ability to rotate into the wind. The supporting members can be made of a lightweight, sturdy metal such as aluminum or other equivalent material including plastic or composite materials to provide a durable and economically produced structure.

The umbrella of this invention is much less labor-intensive to produce when compared to prior art patio umbrellas. The canopy of this invention can be constructed of a single or multiple pieces of fabric or plastic with additional strips sewed or attached thereto to form the channels and sleeves of the canopy. In the structure of this invention there are few support members and ribs, and such members can be easily and quickly inserted and retained within their respective sleeves and channels and manually interengaged to one another telescopically or by other well known means of pole attachment.

Although the present invention has been described with reference to particular embodiments, it will be apparent to those skilled in the art that variations and modifications can be substituted therefor without departing from the principles and spirit of the invention.

I claim:

1. A aerodynamic umbrella for use outdoors where wind conditions can occur, comprising:

a vertically disposed mast;

a canopy having a front portion, a rear portion, a top and a length;

means to rotatably attach said front portion of said canopy to said mast;

means to pivot said canopy to face into the wind; and a stabilizer member having a top edge extending from said top of said canopy along said length of said canopy;

wherein said means to rotatably attach said canopy to said mast include a horizontally disposed extension shaft having a first end and a second end, said horizontally disposed extension shaft at said second end rotatably engaged in a perpendicular relationship to said mast, said canopy attached at said front portion to said first end of said horizontally disposed extension shaft.

2. The aerodynamic umbrella of claim 1 wherein said stabilizer member extends upwards from said top of said canopy generally above said horizontally disposed extension shaft, said canopy further including:

a first sleeve member and a second sleeve member, said sleeve members disposed along said front portion of said canopy;

a channel defined along said top edge of said stabilizer member;

a first support member and a second support member disposed, respectively, within said first sleeve member and said second sleeve member, said first and second support members interconnected to said first end of said horizontally disposed extension shaft; and a central support member disposed within said channel defined along said top edge of said stabilizer member, said central support member having a first end, said first end interconnected to the junction formed by the interconnection of said horizontally disposed extension shaft and said first and second support members.

3. The aerodynamic umbrella of claim 2 further including:

a first channel defined in said canopy extending from said first sleeve member to said rear portion of said canopy;

a first rib member having a length disposed within said first channel;

a second channel defined in said canopy extending from said first end of said channel disposed along said top edge of said stabilizer member to said rear portion of said canopy, said second channel disposed generally below said stabilizer member;

a second rib member having a length disposed within said second channel;

a third channel defined in said canopy extending from said second sleeve member to said rear portion of said canopy; and a third rib member having a length disposed within said third channel.

4. The aerodynamic umbrella of claim 3 further including means to apply tension along the length of each of said first, second and third rib members to cause a curvature in said canopy that is higher near said front portion of said canopy than at said rear portion of said canopy.

5. An aerodynamic umbrella, comprising:

a vertically disposed mast having a top and a bottom;

a canopy having a length, a width, a first side, a second side, a middle, a top surface, a bottom surface, a front portion and a rear portion, said rear portion having a first rear corner and a second rear corner;

pivot means disposed at said top of said mast;

a horizontally disposed extension shaft having a first end and a second end, said second end disposed at said front portion of said canopy;

means to rotatably attach said first end of said horizontally disposed extension shaft by said pivot means in perpendicular relationship to said mast;

a junction member having a first, second, third and fourth interconnection means, said second end of said horizontally disposed extension shaft interconnected to said first interconnection means, said junction member forming the nose of said umbrella;

a second channel defined in the middle of said canopy extending said length of said canopy, said second channel having a first end disposed at said front portion of said canopy and a second end disposed at said rear portion of said canopy, said second end having an aperture defined therein;

a stabilizer member having a length, a height, a top edge, a first end and a second end, said first end disposed toward said front portion of said canopy and said second end disposed at said rear portion of said canopy, said stabilizer member disposed on said top surface of said canopy in parallel alignment above said second channel, said stabilizer member having a greater height at said second end than at said first end, said stabilizer member having a central support member receipt channel defined along said top edge thereof;

a first sleeve and a second sleeve, said first and second sleeves defined in said front portion of said canopy, said first and second sleeves each having a length, an inner end and an outer end, said inner ends of said first and second sleeves each having an aperture defined therein, said first and second sleeves each extending laterally to said horizontally disposed extension shaft at an acute angle thereto;

a first channel and a third channel defined in said canopy and disposed one on each side of said second channel and in parallel alignment therewith, said first and third channels each having a first end and a second end, said first ends of said first and third channels disposed, respectively, along said lengths of said first and second sleeves, said second ends of said first and second channels disposed, respectively, at said first rear corner and said second rear corner of said canopy, said second ends of said first and second channels each having an aperture defined therein;

a first rib member having a first end and a second end, said first rib member disposed in said first channel, said first end of said first rib member disposed adjacent to said first sleeve;

a second rib member having a first end and a second end, said second rib member disposed in said second channel, said first end of said second rib member disposed adjacent to said first end of said second channel;

a third rib member having a first end and a second end, said third rib member disposed in said third channel, said first end of said third rib member disposed adjacent to said second sleeve;

a first support member having a first end and a second end, said first support member disposed within said first sleeve, said first end of said first support member interconnected to said second interconnection means and disposed in the same horizontal plane as, and at an acute angle to, said horizontally disposed extension shaft;

a second support member having a first end and a second end, said second support member disposed within said second sleeve, said first end of said second support member interconnected to said third interconnection means and disposed in the same horizontal plane as, and at an acute angle to, said horizontally disposed extension shaft;

a central support member having a first end and a second end, said central support member disposed in said central support member receipt channel with said first end interconnected to said fourth interconnection means, said central support member disposed extending rearward from said nose above said horizontally disposed extension shaft; and a first, second and third channel closure means disposed, respectively, at said second ends of said first channel, second channel and third channel, said channel closure means to retain said first rib member, said second rib member and said third rib member, respectively, within said first channel, said second channel and said third channel under tension.

6. The aerodynamic umbrella of claim 5 wherein said first rib member, second rib member and third rib member are curved upward by said tension near their respective first ends.

7. The aerodynamic umbrella of claim 6 wherein said canopy is keystone shaped when viewed from above.

8. The aerodynamic umbrella of claim 7 wherein said first ends of said first and third channels are disposed, respectively, approximately midway along said first and second sleeves.

* * * * *